US007128518B2

(12) United States Patent
Yamashita

(10) Patent No.: US 7,128,518 B2
(45) Date of Patent: Oct. 31, 2006

(54) WORKING VEHICLE

(75) Inventor: Masaaki Yamashita, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 11/102,637

(22) Filed: Apr. 11, 2005

(65) Prior Publication Data

US 2005/0196262 A1 Sep. 8, 2005

Related U.S. Application Data

(63) Continuation of application No. PCT/JP03/013396, filed on Oct. 20, 2003.

(30) Foreign Application Priority Data

Oct. 21, 2002 (JP) ..... 2002-306252

(51) Int. Cl.
*E02F 3/38* (2006.01)

(52) U.S. Cl. ..... 414/694; 414/686

(58) Field of Classification Search ..... 414/686, 414/690, 694; 52/116, 117
See application file for complete search history.

(56) References Cited

U.S. PATENT DOCUMENTS 4,185,945 A * 1/1980 Gill ..... 414/727
5,437,531 A * 8/1995 Kress ..... 414/555

FOREIGN PATENT DOCUMENTS

| | | |
|---|---|---|
| JP | 06-033476 | 2/1994 |
| JP | 08-049250 | 2/1996 |
| JP | 08-081972 | 3/1996 |
| JP | 11-158905 | 6/1999 |
| JP | 2001-064990 | 3/2001 |
| JP | 2003-041610 | 2/2003 |

OTHER PUBLICATIONS

International Search Report for PCT/JP03/13396, completed on Jan. 20, 2004.

* cited by examiner

*Primary Examiner*—Donald Underwood
(74) *Attorney, Agent, or Firm*—Sterne, Kessler, Goldstein & Fox, P.L.L.C.

(57) ABSTRACT

A lift arm (9) includes a first arm (11) and a second arm (12). A pivot joint portion (32) where the first arm (11) is pivoted on a bracket (8) stood at a vehicle side portion substantially corresponds to the rear end of an operation control portion. A rod (15) as a swing motion-limiting member is interposed between the bracket (8) and the second arm (12). An angle of bend formed by the first arm (11) and the second arm (12) is set to be large at a lowered position of the lift arm and small at a lifted position.

22 Claims, 7 Drawing Sheets

WORKING VEHICLE

CROSS-REFERENCE TO RELATED APPLICATION

The present application is a continuation of International Application No. PCT/JP2003/013396, filed on Oct. 20, 2003, designating the U.S., and claiming priority to JP 2002-306252, filed on Oct. 21, 2002.

FIELD OF THE INVENTION

The present invention relates to a working vehicle, such as a skid steer loader, which can work in a narrow space, and especially relates to a structure of lift arms extended forward from the rear part of the vehicle.

BACKGROUND ART

Conventionally, there is a well-known working vehicle called as a skid steer loader, which can turn on a small circle with driving wheels by operating steering levers provided in an operation control portion so as to carry out loading and dumping work in a limited space. Generally, the skid steer loader is equipped on a side portion thereof with a lift arm, which is formed in an approximate inverse L-shape in a side view, and extended forward from a rear portion of the vehicle. The lift arm can lift up and down a working machine, such as a bucket, attached on a front end of the arm, in the almost vertical direction relative to the ground.

Such a skid steer loader is desired to have a sufficiently long bucket reach when the lift arm is lifted up at an uppermost position. To achieve this request, the vehicle requires a bracket to support the lift arm. The bracket tends to be a big structure so as to have enough strength. A bigger bracket is needed for a longer bucket reach. However, a big bracket sometimes obstructs an operator's rear or side view from the operation control portion so badly that the operator feels difficulty in backing and turning operation of the vehicle.

To solve the above problem, a conventional type skid steer loader is disclosed in JP-Hei6(1994)-33476, in which the operator's side view is improved without increasing the number of needed links.

However, in each of the conventional skid steer loaders, the lift arm, while being lifted up, moves away from the vehicle body so as to have a bad influence on the skid steer loader in its fore-and-aft balance and its loading and dumping work, because the arm is integrally formed between its ends pivoted onto the bracket and the working machine, so as to have a constant angle bend.

Besides, JP-Hei11(1999)-158905 discloses a conventional art relating to a skid steer loader, in which an operator doesn't have to move the vehicle back and forth so much in dumping stuff loaded on a bucket onto a truck etc. Furthermore, according to the document, some other problems are also solved to improve operability of loading and dumping work. For example, the vehicle is prevented from lurching backward when the bucket is being lifted up.

However, the above conventional skid steer loader is configured in such a way that the bucket is positioned at the forefront of the vehicle when the lift arm is lifted up at an uppermost position. Therefore, the vehicle tends to lose balance in dumping stuff loaded on the bucket onto a truck etc.

JP-2001-64990 discloses a skid steer loader which is equipped with a slidable arm on a main arm of a lift arm. The slidable arm is slidable against the main arm so that a bucket provided thereon should move on a demanded locus, such as a vertical line, a circular arc, etc. in loading and dumping work.

However, the above-described skid steer loader has a complex mechanism and is expensive in exchange for having a desired bucket locus because it needs additional elements, such as sensors for detecting a distance slid by the slidable arm and a tilt angle of the bucket, controllers for controlling the lift arm on the basis of detection values, and several control valves.

In view of the above-described problems, the present invention aims for providing a skid steer loader which secures a wide rear and side view field for an operator in an operation control portion, and which keeps stable balance even when a lift arm is lifted up at an uppermost position. The present invention also aims for providing a simple mechanism for lifting up the lift arm keeping an opening of a bucket face almost upward.

SUMMARY OF THE INVENTION

A working vehicle according to the present invention comprises: a bracket stood on a rear portion of a vehicle body; a lift arm vertically turnably provided on the bracket and extended forward; a working machine attached on the lift arm before the vehicle body. The lift arm includes a rear-side first arm and a front-side second arm, whereby a distance from a basal end of the first arm to a front end of the second arm can be varied. Therefore, the lift arm can be lifted up keeping it as close to the vehicle body as possible. Also, an enough bucket reach can be secured when the lift arm is lifted up at an uppermost position thereof.

Furthermore, a swing motion-limiting member is interposed between the bracket and the second arm so that an angle of bend formed by the first arm and the second arm is set to be large at a lowered position of the lift arm and small at a lifted position, whereby the lifted-up working machine can extremely approach the vehicle body. Therefore, an enough bucket reach can be secured at a lifted-up position of the working machine.

Furthermore, according to the present invention, a pivot joint portion between the first arm and the vehicle body substantially corresponds to the rear end of an operation control portion, so that the bracket supporting the lift arm is positioned behind the operation control portion and prevented from obstructing an operator's side view. Furthermore, an operator's view from the operation control portion is highly improved when the lift arm is lifted up at the uppermost position thereof while securing an enough bucket reach.

Furthermore, a swing motion-limiting member is interposed between the bracket and the second arm so that an angle of bend formed by the first arm and the second arm is set to be large at a lowered position of the lift arm and small at a lifted-up position, whereby the working machine is kept close to the vehicle body during being lifted-up. Therefore, an enough bucket reach can be secured at the lifted-up position of the working machine.

Furthermore, the swing motion-limiting member is a rod, one end of the rod being joined to a portion above a pivot joint portion between the first arm and the bracket, and the other end of the rod being joined to a portion below a pivot joint portion between the first arm and the second arm. This configuration achieves an easy and economical way for the angle of bend formed by the first arm and the second arm. The rod and the first arm are disposed substantially parallel to each other, thereby minimizing a hidden area of the operator's side view when the lift arm is lifted up.

Furthermore, a cylinder for the working machine is disposed on a side of the second arm opposite to the vehicle body, and a tip end of the cylinder is connected to the working machine and the second arm via links, whereby an angle range of swing of a bucket can be increased without deteriorating an operator's view from the operation control portion. Therefore, an enough bucket dump angle is secured even at an uppermost position of the bucket.

Furthermore, a cylinder for the working machine is disposed on a side of the second arm opposite to the vehicle body, and a basal portion side of the cylinder is connected to a tip end of the first arm, whereby the angle of bend between the first arm and the second arm varies automatically as the lift arm is lifted up. Therefore, the bucket can be automatically leveled without any additional component.

Furthermore, the lift arms are provided in a left and right pair, and a cross member is spanned between ends of the first arms so as to increase rigidity of the lift arms. Therefore, the first arms never bend even when an imbalanced load is applied on the bucket.

Furthermore, the cross member is in a U shape in a front view, whereby rigidity of the first arms is increased without obstructing an operator getting on and off the vehicle.

Furthermore, a nonskid pad for getting on and off the vehicle is provided on an upside of a lateral center portion of the cross member, whereby an operator can stably get on and off the operation control portion.

Furthermore, the lift arms are provided in a left and right pair, and a cross member is spanned between the left and right second arms, whereby the second arms never bend even when an imbalanced load is applied on the bucket.

Furthermore, a rubber crawler is employed for a traveling system of the working vehicle, whereby grounding pressure is decreased. Therefore, the vehicle can have good running performance even on a damp ground, or on a soft road.

DETAILED DESCRIPTION OF THE INVENTION

Detailed description will be given of the present invention following the attached figures.

First, description will be given of an overall structure of a skid steer loader as an example of a working vehicle having a lift arm structure according to the present invention.

Figure 1:
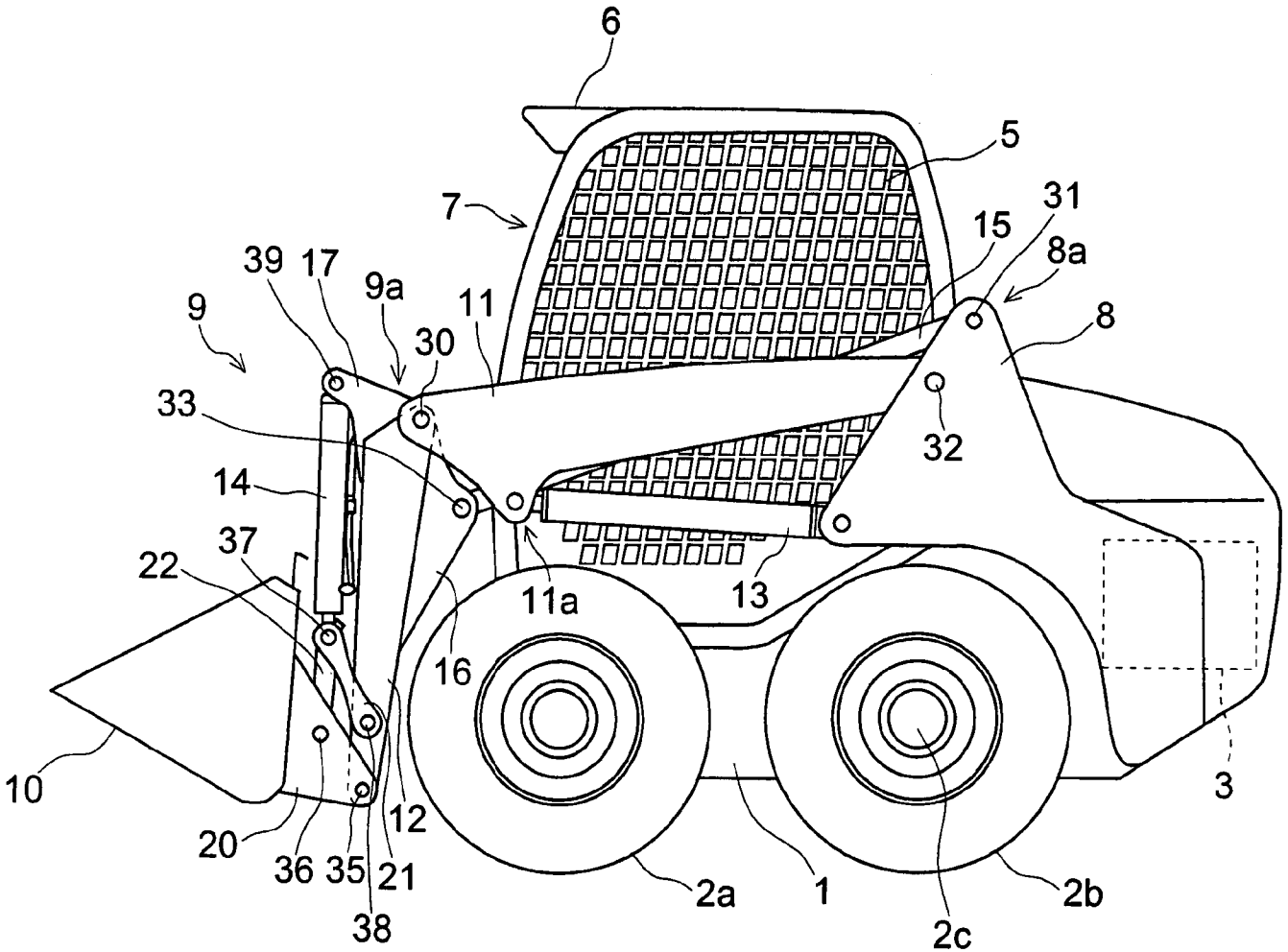
FIG. 1 is a side view of a skid steer loader as an example of a working vehicle according to the present invention showing an overall structure thereof.

As shown in FIG. 1, the skid steer loader is provided on a lower portion of a body 1 thereof with front wheels 2*a* and 2*a* and rear wheels 2*b* and 2*b*, and provided inside a rear portion of body 1 with an engine 3. An operation control portion is disposed on a front portion of body 1, where operation levers, operation pedals, a seat, etc. are provided. Left and right sides of the operation control portion are covered with net guards 5 and 5, stood on either side of body 1, and with a roof 6, fixed on tops of net guards 5 and 5. The operation control portion has a front opening, through which an operator enters the operation control portion and sits on a seat therein for various operations. Left and right brackets 8 and 8, which are triangle-shaped in a side view, are provided upright on respective left and right sides of the rear portion of body 1. A lift arm 9 is pivoted on an upper portion of each bracket 8 and extended forward. A front portion of each lift arm 9 is bent in an approximate inverse L-shape. A working machine, such as a bucket 10, is mounted on tip ends of lift arms 9 and 9.

The operation control portion is provided therein with left and right steering levers (not shown) for independently controlling rotation of respective left and right front wheel 2*a* and rear wheel 2*b*. Therefore, a traveling direction of the vehicle can be changed by differentiating rotational speed between the left pair of front and rear wheels 2*a* and 2*b* and the right pair of front and rear wheels 2*a* and 2*b*. Furthermore, the vehicle can spin by driving the left pair of wheels 2*a* and 2*b* and the right pair of wheels 2*a* and 2*b* in opposite directions.

Alternatively, a single steering lever, a steering wheel or the like can be used for steering operation instead of the above-described left and right steering levers. Further, alternatively, left and right pedals can be used instead of the left and right steering levers.

Still further, alternatively, a pair of levers can be provided, one of which is used for steering operation, and the other of which is used for operation of the lift arms, the bucket, etc. Alternatively, pedals can be used for steering operation or for operation of the lift arms, the bucket, etc.

Description will now be given of the mechanism of the lift arms.

As described above, forwardly extended left and right lift arms 9 are vertically turnably pivoted at the rear ends thereof on the pair of brackets 8 and 8, erected on the left and right sides of the rear portion of body 1. According to the present invention, each lift arm 9 includes two arms, namely, front and rear arms with a bending portion 9*a*between them. The rear arm is designated as a first arm 11, and the front arm as a second arm 12.

As shown in FIG. 1, when each lift arm 9 is lowered at the lowermost position, first arm 11 is disposed substantially horizontally with respect to the ground, and second arm 12 in the initial position (when not worked) is disposed vertically with respect to the ground, so that lift arm 9 looks like an inverse L shape in a side view. First arm 11 is pivoted at the basal (rear) side portion thereof onto an upper portion of bracket 8 with a pin 32. Pin 32, which serves as a turning center axis of lift arm 9, is disposed above an axle 2*c* of rear wheel 2*b*.

Each second arm 12 is longitudinally turnably pivoted at the basal portion thereof onto the forefront portion of first arm 11 with a pin 30. A joint portion between the basal side of first arm 11 and the upper portion of bracket 8 substantially corresponds to a rear end portion of the operation control portion in the fore-and-aft direction. Furthermore, the joint portion is positioned lower than the level of an operator's eyes. Therefore, when lift arm 9 is lowered, it is positioned below the operator's view so that it doesn't obstruct the operator's view.

A lift cylinder 13 is provided below first arm 11. Lift cylinder 13 is pivoted at a rear end thereof onto a portion of bracket 8 forward and downward from pin 32. Also, lift cylinder 13 is pivoted at a front end thereof onto a jutting portion 11*a*, jutting downward from a bottom portion on the front side of first arm 11, and lift cylinder 13 is disposed substantially parallel to first arm 11. The pair of left and right first arms 11 are provided therebelow with respective lift cylinders 13 which are expanded and contracted by operating a control lever provided in the operation control portion. First arms 11 are turned vertically (longitudinally) by expansion and contraction of lift cylinders 13.

Vertical bucket cylinders 14, serving as actuators for driving a working machine, are provided on a side of respective second arms 12 opposite to body 1, namely, the front side (or upper side when the lift arms are raised) of second arms 12. Each bucket cylinder 14 is pivoted at a basal portion thereof onto a stay 17 projecting forward from the base side of second arm 12. Bucket cylinder 14 is connected at the front end (lower end) side thereof to bucket 10 and the tip end of second arm 12 via links 21 and 22. Description will be given of links 21 and 22 more in detail later. Similar to lift cylinders 13, bucket cylinders 14 are expanded and contracted so as to vertically turn bucket 10 attached on the tip ends of lift arms 9, thereby adjusting a turning angle of bucket 10.

A connecting rod 15 is interposed between bracket 8 and second arm 12 in such a way that rod 15 crosses first arm 11 in a side view. Rod 15 serves as a swing motion-limiting member that limits an angle of bend of lift arm 9 while lift arm 9 is lifted up and down.

More specifically, rod 15 is pivoted at a rear end thereof onto a triangular upper end portion 8*a* of bracket 8 with a pin 31. A front end of rod 15 is pivotally joined to a stay 16 projecting backward (downward when lifted up) from an upper rear portion of second arm 12. Pin 31, with which rod 15 is pivotally joined to bracket 8, is arranged rearward and upward from pin 32, which serves as a pivot joint portion between first arm 11 and bracket 8. A pivot joint portion between rod 15 and stay 16 is disposed lower than pin 30 pivotally connecting first arm 11 and second arm 12 to each other. Therefore, in a side view, rod 15 and first arm 11 cross each other while extending nearly parallel to each other (so that they cross each other at a very small angle), thereby reducing an occupied area of the side view from the operation control portion as much as possible, so as to be prevented from obstructing the operator's view when lift arm 9 is lifted up and down.

Figure 6:
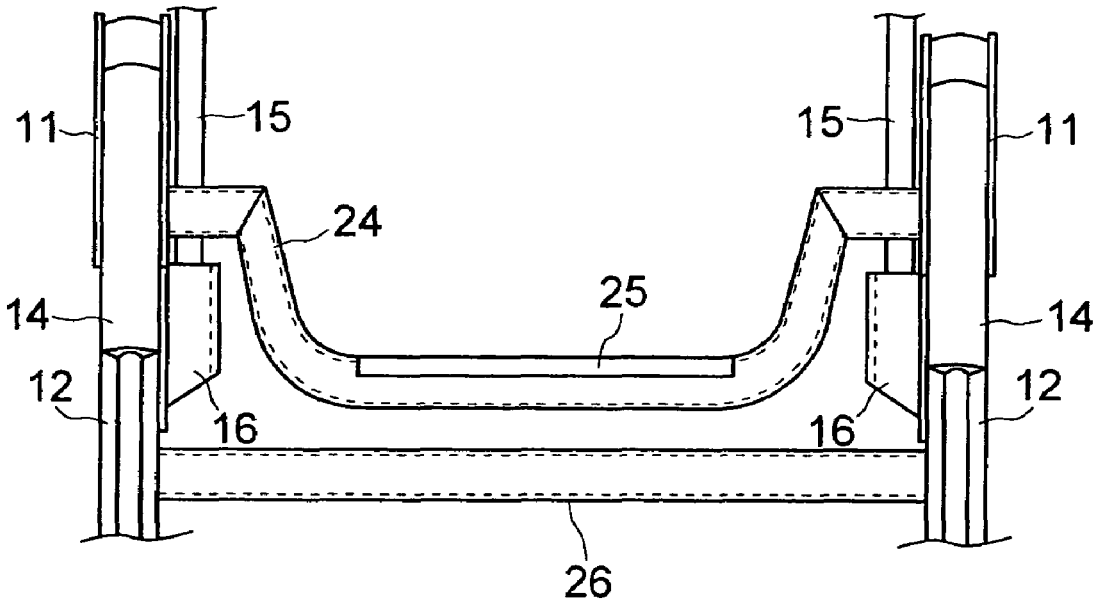
FIG. 6 is a front view showing the configuration of the cross member.

Here, as shown in FIG. 6, rod 15 is disposed on the proximal side of first arm 11 (toward the operation control portion) so as to be prevented from interfering with first arm 11.

In the above lift arm structure, if rod 15 and first arm 11 were arranged in parallel to each other, second arm 12 would be lifted up with an unchanging angle thereof (in the vertical direction) with respect to first arm 11, then bucket 10 would hit the operation control portion.

Figure 2:
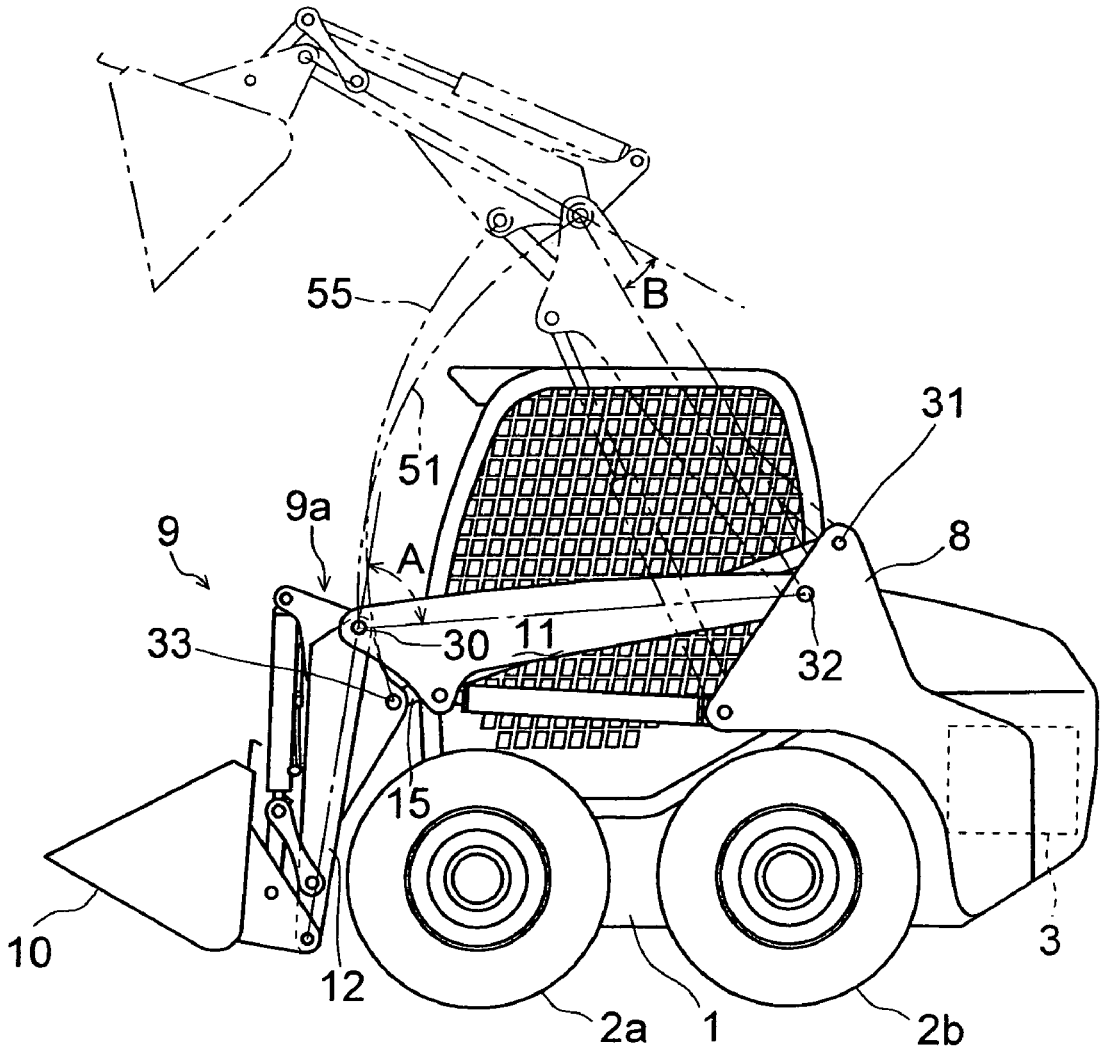
FIG. 2 is a side view of the skid steer loader showing comparison between an angle of bend A of a lift arm at a lowermost position thereof and an angle of bend B of the lift arm at an uppermost position thereof.

However, according to the present invention as shown in FIG. 2, rod 15 and first arm 11 are arranged to cross each other, so that, when the lift arm is lifted up, first arm 11 is turned upward around the central axis of pin 32, and second arm 12, pivoted on a front end of first arm 11 with pin 30, is simultaneously lifted up. Meanwhile, rod 15 turns upward around pin 31. In the middle course of the turning of rod 15, a locus 51 of pin 30 on the front end of first arm 11 crosses a locus 55 of pin 33, which serves as a connecting axis between second arm 12 and rod 15. During the upward turning, the angle of bend formed by first arm 11 and second arm 12 is gradually decreased from an angle A at a lowermost position of the lift arm to an angle B at an uppermost position.

In this regard, as lift arms 9 are lifted up, second arms 12 are pushed forward by rods 15 and turned forward-upward, so as to prevent bucket 10, a later-discussed cross member 24, etc. from interfering with the operation control portion.

Therefore, the working machine can extremely approach the operation control portion, whereby an operator can easily view the position of working. Furthermore, the fore-and-aft length of the whole vehicle body can be shortened, thereby reducing a radius of a turning circle of the vehicle. Still further, an operator's side view from the operation control portion is improved.

Furthermore, as described above, each rod 15 is pivoted onto bracket 8 at a different position from the pivot joint portion between bracket 8 and first arm 11, and is extended across first arm 11 and pivoted onto second arm 12. Therefore, when lift arms 9 are lifted up, the angle of bend A formed by first arm 11 and second arm 12 is gradually decreased, and second arms 12 are turned forward, thereby lifting up bucket 10 to a high position. Further, mutually crossing first arm 11 and rod 15 extend nearly parallel to each other (so that they cross each other at a very small angle), thereby minimizing a hidden area of an operator's side view from the operation control portion.

A turnbuckle or the like may be used to change the length of each rod 15 so as to adjust the angle of bend of first arm 11 with respect to second arm 12 when lift arms 9 are lifted up and down. Alternatively, cylinders or the like replacing rods 15 can be expanded and contracted so as to raise lift arms 9 with the best angle of bend for good weight balance and for preventing lift arms 9 from interfering with other components. As a result, lift arms 9 can be lifted up still higher.

Now, description will be given of a structure of the links and bucket 10 provided on the tip ends of lift arms 9, referring to FIG. 1. Bucket 10 as a working machine is connected to the tip end of second arm 12 of each lift arm 9 via links 21 and 22.

To be more in detail, a pair of left and right triangular supporting stays 20 project from a rear portion of bucket 10. The tip end of second arm 12 is pivoted onto a lower rear end of each supporting stay 20 with a pin 35. On the other hand, the basal end of each bucket cylinder 14 is pivoted onto stay 17 with a pin 39. A tip of a piston rod of bucket cylinder 14 is pivoted onto one ends of link 21 and 22 with a pin 37. The other end of link 22 is pivoted onto an upper front portion of supporting stay 20 with a pin 36, and the other end of link 21 is pivoted onto the tip end portion of second arm 12 with a pin 38, nearer to the basal end of second arm 12 than pin 35. Therefore, pins 37, 38, 35 and 36 are arranged in such a way that a line connecting them in this order forms an approximate parallelogram.

Due to the above structure, bucket 10 can turn around the central axis of pin 35 as bucket cylinders 14 are expanded and contracted.

Figure 3:
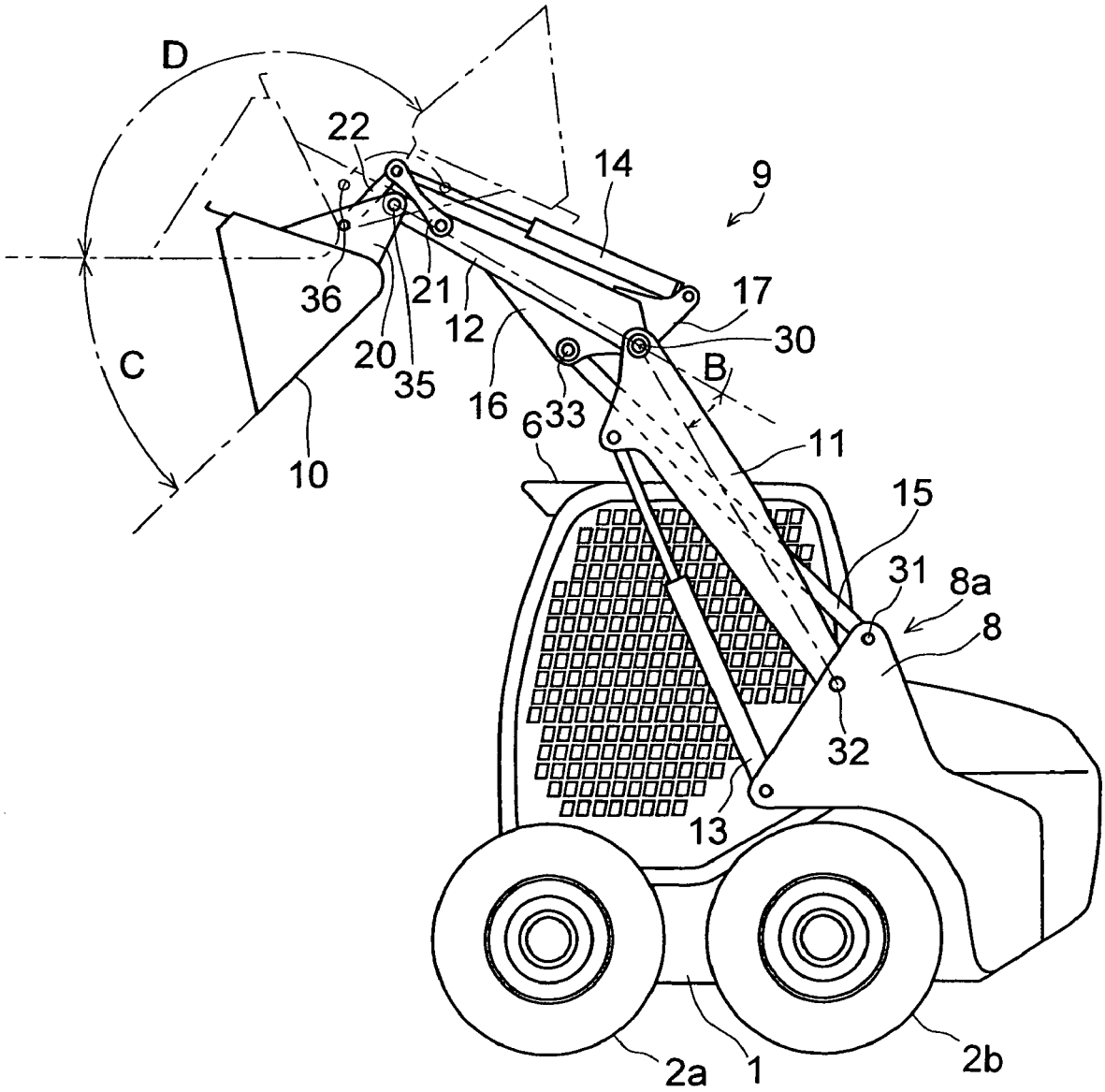
FIG. 3 is a side view of the skid steer loader showing a range of swing of a bucket at the uppermost position of the lift arm.

In other words, in the skid steer loader, the link mechanism around the bucket used for a backhoe etc. is provided on the tip ends of the lift arms so that a turning angle of the bucket can be increased without deteriorating the operator's view from the operation control portion. Furthermore, as shown in FIG. 3, even when bucket 10 is lifted up at an uppermost position, the angle of bucket 10 is sufficient for dumping. To be more specifically, according to the present embodiment, a downward turning angle of about 45 degrees and an upward turning angle of about 140 degrees are secured for dumping, on the assumption that an initial angle of bucket 10 is taken when bucket 10 stays in parallel to the ground.

Next, description will be given of a second embodiment of the lift arm structure.

Figure 4:
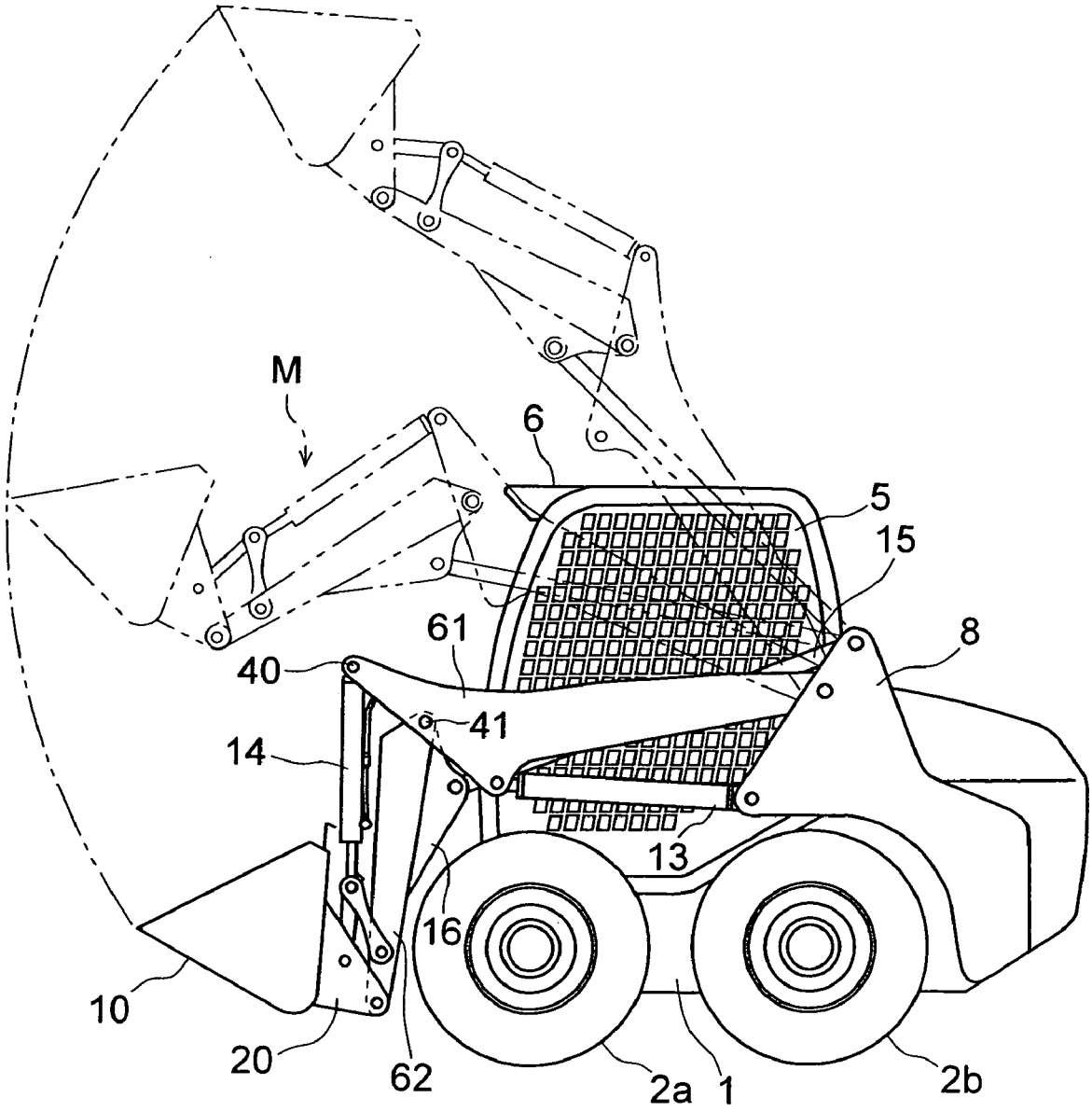
FIG. 4 is a side view of the skid steer loader showing a structure of a lift arm according to a second embodiment and a lifting-up course thereof.

In the present embodiment, as shown in FIG. 4, basal end portions of bucket cylinders 14 are fixed on tip ends of respective first arms 61.

To be more in detail, in the present embodiment, the tip end portion of each first arm 61 is inclined backward (forward-upward when not in operation), and the basal portion of each bucket cylinder 14 is pivoted onto the front end of first arm 61 with a pin 40, in comparison with the first embodiment, in which the basal portion of each bucket cylinder 14 is fixed onto stay 17, projecting forward from the basal portion of second arm 12. Furthermore, in the present embodiment, a second arm 62 is pivoted with a pin 41 onto a portion of first arm 61 slightly backward from the tip end thereof, and rod 15 is pivoted onto stay 16, projecting from the rear side of second arm 62, similar to stay 16 in the first embodiment.

Due to this configuration, an angle of bend of each lift arm 9 is gradually decreased as first arm 61 is lifted up, similar to that in the first embodiment. Furthermore, since each bucket cylinder 14 is supported at the tip end of first arm 61, an opening of bucket 10 is turned upward following movement of lift arms 9 in the direction for decreasing the angle of bend thereof.

As described above, since each first arm 61 is provided with a portion for supporting one side of bucket cylinder 14, lift arm 9 can be lifted up keeping the opening of bucket 10 face almost upward in cooperation with change of the angle of bend formed by first arm 61 and second arm 62. This means that bucket 10 can be automatically leveled without any additional component.

The angle of bend formed by arms 61 and 62 is controlled by driving cylinder 13 and by swing motion-limiting of rod 15, so that the position of lift arms 9 (position M in FIG. 4) during lifting-up can be brought closer to the body side. At the same time, a sufficient bucket reach can be secured at a lifted-up position of the lift arms. It should be noted that the same thing happens in the vehicle according to the first embodiment.

Next, description will be given of a lift arm structure according to a third embodiment, wherein a cross member is added to the lift arm structure according to the first and second embodiment.

Figure 5:
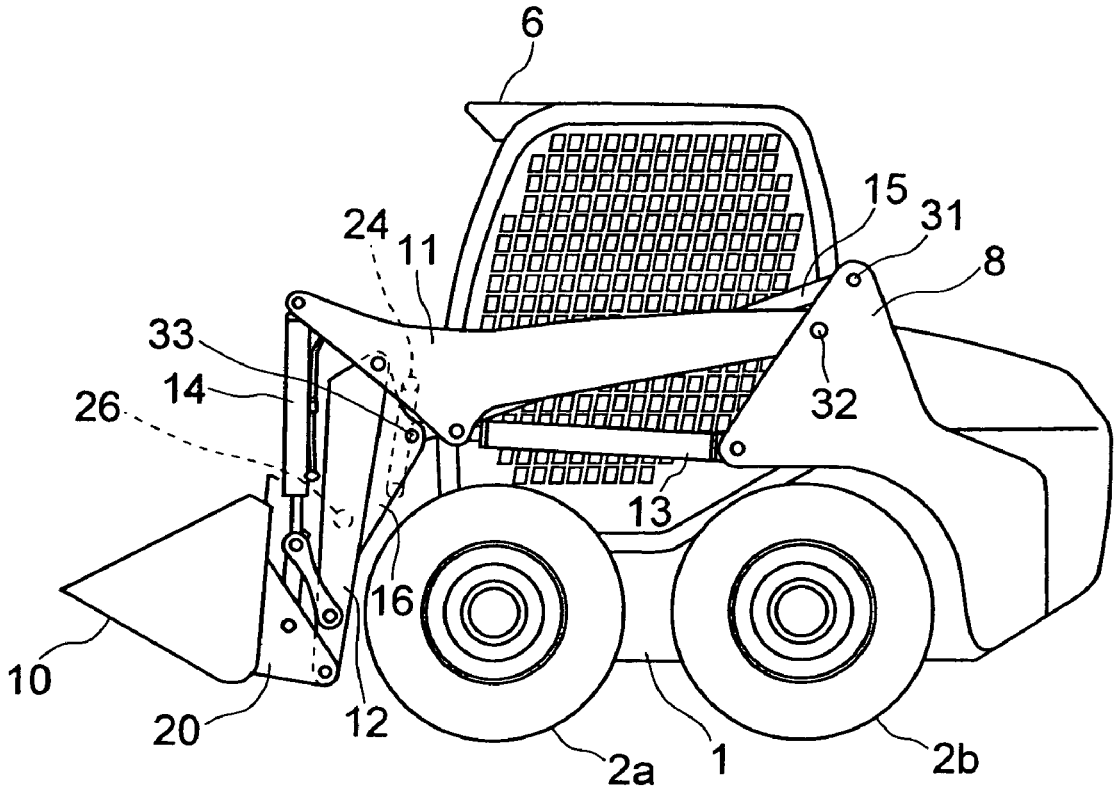
FIG. 5 is a side view of the skid steer loader showing a configuration of a cross member.

As shown in FIG. 5 and FIG. 6, a cross member 24, approximately U-shaped in a front view, is spanned between front portions of left and right first arms 11 and 11. Cross member 24 is arranged in such a way that left and right vertical portions thereof extend substantially parallel to second arms 12 in a side view when the lift arms are at a lowered position. Both ends of cross member 24 are bent outward-upward and fixed onto proximal side surfaces of respective first arms 11. The fixed both ends of cross member 24 are positioned above respective stays 16 and 16 projecting from respective second arms 12, so as to prevent cross member 24 from interfering with stays 16 and rods 15 pivoted on respective stays 16. Furthermore, a nonskid pad 25, made of a steel plate, a mat or the like, is provided on an upside surface of the lateral center portion of cross member 24.

Furthermore, a left-and-right directed straight rod-like cross member 26 is spanned between (below) second arms 12 and 12. Both ends of cross member 26 are fixed onto proximal side surfaces of second arms 12 and 12.

In this way, cross member 24 is spanned between first arms 11, and cross member 26 is spanned second arms 12, so that both ends of respective cross members 24 and 26 are fixed to first arms 11 and second arms 12. As a result, first arms 11 and second arms 12 are increased in rigidity, so as to be prevented from bending even when an imbalanced load is applied thereon due to a heavy burden loaded on bucket 10. Furthermore, since cross member 24 spanned between first arms 11 is formed in a U-shape, it is not obstructive to an operator getting on and off the operation control portion. Still further, since cross member 24 is disposed at a lower position, it is prevented from interfering with rods 15, the stay fixed onto second arms 12, etc.

In addition, nonskid pad 25, made of a steel plate, a mat, etc., is provided on the upside surface of the lateral center portion of cross member 24, so that an operator can get on and off the operation control portion using nonskid pad 25 as a step.

Figure 7:
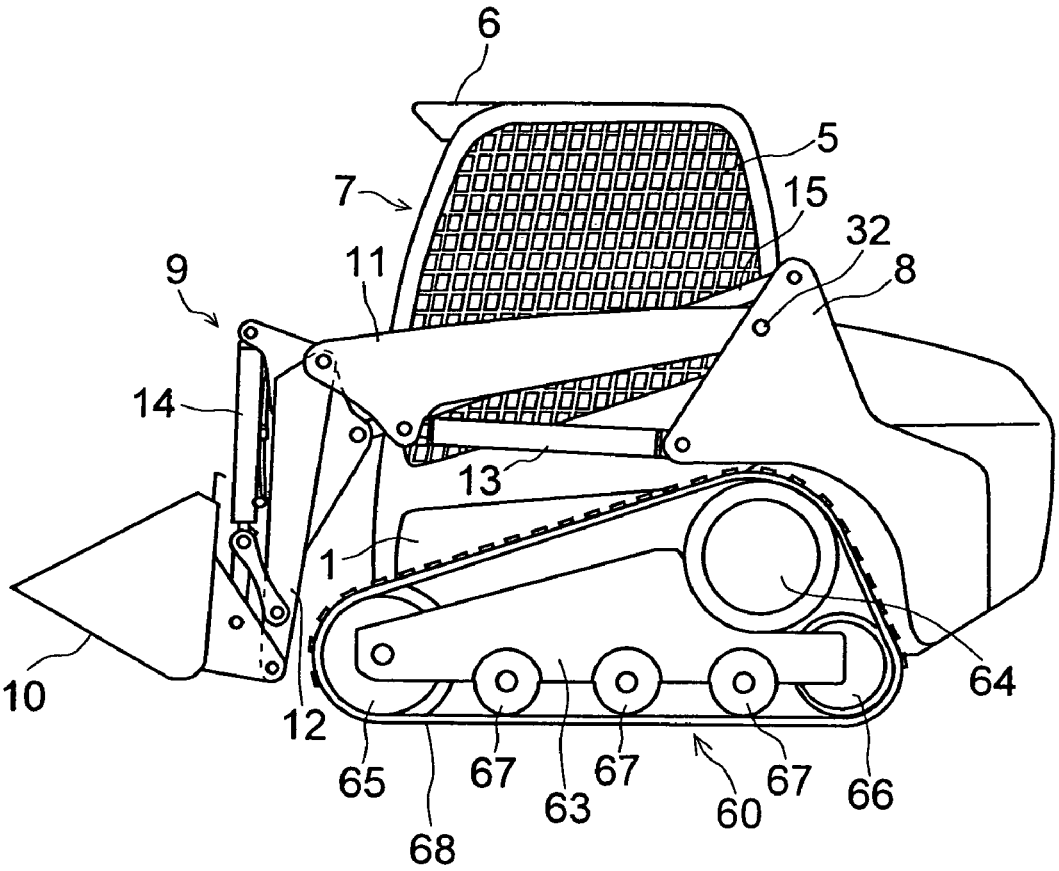
FIG. 7 is an overall side view of a skid steer loader having a rubber crawler.

In the above embodiment, the skid steer loader has the wheel type driving system. Alternatively, it may have a crawler type driving system, like rubber crawlers 60 as shown in FIG. 7.

The loader has lift arm 9, the lifting mechanism of lift arm 9 and the other components on the upper part of the vehicle body, similar to the above structure, and has the crawler driving system replacing the wheel driving system. Rubber crawler 60 is provided on a truck frame 63 extended in the fore-and-aft direction on each of opposite sides of the lower part of body 1. A driving wheel 64 is supported on an upper rear portion of truck frame 63.

Trailing wheels 65 and 66 are rotatably disposed on lower front end and lower rear end of truck frame 63, respectively. Free wheels 67 are disposed between trailing wheels 65 and 66. A crawler belt 68 is wound around driving wheel 64, trailing wheels 65 and 66 and free wheels 67, whereby the vehicle can be driven as well as a wheel-type vehicle. In this case, grounding pressure can be reduced, thereby beneficially obtaining large traction power.

INDUSTRIAL APPLICABILITY

As described above, the present invention provides a skid steer loader, having an enough wide field of vision for an operator. Furthermore, a working machine attached on the loader never inclines forward largely in lifting-up operation. Therefore, it can be used in construction work etc.

What is claimed is:

1. A vehicle comprising:

a bracket stood on a rear portion of a vehicle body;

a lift arm vertically turnably provided on said bracket and extended forward, and including a rear-side first arm and a front-side second arm;

a working machine attached on said lift arm before said vehicle body; and a swing motion-limiting member interposed between said bracket and said second arm so that an angle of bend formed by said first arm and said second arm is set to be large at a lowered position of said lift arm and small at a lifted position, wherein one end of said swing motion-limiting member is joined to a portion above a pivot joint portion between said first arm and said bracket, and another end of said swing motion-limiting member is joined to a portion below a pivot joint portion between said first arm and said second arm.

2. A vehicle according to claim 1, wherein a pivot joint portion between said first arm and said vehicle body substantially corresponds to a rear end of an operation control portion.

3. A vehicle according to claim 1, wherein said swing motion-limiting member is a rod having a fixed length.

4. A vehicle according to claim 1, wherein a cylinder for said working machine is disposed on a side of said second arm opposite to said vehicle body, a tip end of said cylinder being connected to said working machine and said second arm via links.

5. A vehicle according to claim 1, wherein a cylinder for said working machine is disposed on a side of said second arm opposite to said vehicle body, a basal portion side of said cylinder being connected to a tip end of said first arm.

6. A vehicle according to claim 1, wherein said lift arms are provided in a left and right pair, and a cross member is spanned between tip ends of said left and right first arms.

7. A vehicle according to claim 6, wherein said cross member is formed in a U shape in a front view.

8. A vehicle according to claim 6, wherein a nonskid pad for getting on and off said vehicle is provided on an upside of a lateral center portion of said cross member.

9. A vehicle according to claim 1, wherein said lift arms are provided in a left and right pair, and a cross member is spanned between said left and right second arms.

10. A vehicle according to claim 1, wherein a rubber crawler is employed for a traveling system of said vehicle.

11. A vehicle comprising:

a bracket stood on a rear portion of a vehicle body;

a lift arm vertically turnably provided on said bracket and extended forward, and including a rear-side first arm and a front-side second arm;

a working machine attached on said lift arm before said vehicle body; and a swing motion-limiting member interposed between said bracket and said second arm so that an angle of bend formed by said first arm and said second arm is set to be large at a lowered position of said lift arm and small at a lifted position;

wherein said lift arms are provided in a left and right pair, and a cross member is spanned between tip ends of said left and right first arms, and wherein said cross member is formed in a U shape in a front view.

12. A vehicle according to claim 11, wherein a nonskid pad for getting on and off said vehicle is provided on an upside of a lateral center portion of said cross member.

13. A vehicle comprising:

a bracket stood on a rear portion of a vehicle body;

a lift arm vertically turnably provided on said bracket and extended forward, and including a rear-side first arm and a front-side second arm;

a working machine attached on said lift arm before said vehicle body; and a swing motion-limiting member interposed between said bracket and said second arm so that an angle of bend formed by said first arm and said second arm is set to be large at a lowered position of said lift arm and small at a lifted position, wherein said swing motion-limiting member is a rod having a fixed length.

14. A vehicle according to claim 13, wherein a pivot joint portion between said first arm and said vehicle body substantially corresponds to a rear end of an operation control portion.

15. A vehicle according to claim 13, wherein one end of said swing motion-limiting member is joined to a portion above a pivot joint portion between said first arm and said bracket, and the other end of said swing motion-limiting member is joined to a portion below a pivot joint portion between said first arm and said second arm.

16. A vehicle according to claim 13, wherein a cylinder for said working machine is disposed on a side of said second arm opposite to said vehicle body, a tip end of said cylinder being connected to said working machine and said second arm via links.

17. A vehicle according to claim 13, wherein a cylinder for said working machine is disposed on a side of said second arm opposite to said vehicle body, a basal portion side of said cylinder being connected to a tip end of said first arm.

18. A vehicle according to claim 13, wherein said lift arms are provided in a left and right pair, and a cross member is spanned between tip ends of said left and right first arms.

19. A vehicle according to claim 18, wherein said cross member is formed in a U shape in a front view.

20. A vehicle according to claim 18, wherein a nonskid pad for getting on and off said vehicle is provided on an upside of a lateral center portion of said cross member.

21. A vehicle according to claim 13, wherein said lift arms are provided in a left and right pair, and a cross member is spanned between said left and right second arms.

22. A vehicle according to claim 13, wherein a rubber crawler is employed for a traveling system of said vehicle.

* * * * *